US010435212B2

(12) United States Patent
Ruhmel et al.

(10) Patent No.: US 10,435,212 B2
(45) Date of Patent: Oct. 8, 2019

(54) VENTILATED SHIPPING TUBE PLUG

(71) Applicants: Reid Ruhmel, Whitehall, PA (US); Emily Heller, Orefield, PA (US)

(72) Inventors: Reid Ruhmel, Whitehall, PA (US); Emily Heller, Orefield, PA (US)

( * ) Notice: Subject to any disclaimer, the term of this patent is extended or adjusted under 35 U.S.C. 154(b) by 458 days.

(21) Appl. No.: 14/957,680

(22) Filed: Dec. 3, 2015

(65) Prior Publication Data

US 2017/0158386 A1 Jun. 8, 2017

(51) Int. Cl.
*B65D 47/32* (2006.01)
*B65D 59/02* (2006.01)
*B65D 85/50* (2006.01)

(52) U.S. Cl.
CPC ..... *B65D 59/02* (2013.01); *B65D 85/50* (2013.01); *B65D 2205/02* (2013.01)

(58) Field of Classification Search
CPC .... B65D 85/50; B65D 47/32; B65D 39/0005; B65D 39/00; B65D 41/0414; B65D 41/46; B65D 41/465; B65D 51/16; B65D 51/1605; B65D 51/1616; B65D 59/00; B65D 59/02; B65D 77/208; B65D 39/0023; B65D 39/007; B65D 39/04; B65D 81/263; B65D 2205/02; B65D 59/06; B65D 59/08; A01K 1/0236; A01K 1/0245; A01K 1/0254
USPC ..... 220/802, 203.13, 370–373, 227, 367.1
See application file for complete search history.

(56) References Cited

U.S. PATENT DOCUMENTS 1,974,549 A 9/1934 Spencer et al.
2,823,694 A 2/1958 Champion
2,859,893 A * 11/1958 Reed ..... B65D 25/24 206/457
2,919,017 A * 12/1959 Weber ..... A45C 7/0031 206/315.11
3,909,414 A 9/1975 Drath
4,232,242 A 11/1980 Hsu
4,385,752 A 5/1983 Hayashi
4,643,019 A * 2/1987 Jones ..... G01N 15/0806 73/38
5,515,971 A * 5/1996 Segrest ..... B65D 85/42 206/418
5,816,292 A 10/1998 Wilson et al.
6,325,234 B1 * 12/2001 Legaspi ..... A47J 36/027 220/367.1
6,715,628 B1 * 4/2004 Nichols ..... A61L 2/26 220/256.1
7,540,392 B2 * 6/2009 Cipra ..... B65F 1/1607 220/254.3
8,734,526 B2 5/2014 Adzich et al.
2004/0148883 A1 8/2004 Lutz
2006/0175333 A1 * 8/2006 Johanson ..... B65D 43/0272 220/270

(Continued)

FOREIGN PATENT DOCUMENTS

WO 2007147204 12/2007
WO 2010002362 1/2010
WO 2011084792 7/2011

*Primary Examiner* — Robert Poon

(74) *Attorney, Agent, or Firm* — Lambert Shortell & Connaughton; Gary E. Lambert; David J. Connaughton, Jr.

(57) ABSTRACT

A ventilated plug for a shipping, display, or other tube is provided. The ventilated plug is configured to frictionally connect to the tube to provide a ventilated interior of the tube. The plug may be particularly advantageous for transport and display of living organisms.

8 Claims, 2 Drawing Sheets

(56) References Cited

U.S. PATENT DOCUMENTS

| | | | | |
|---|---|---|---|---|
| 2007/0241007 | A1* | 10/2007 | Kwan | A47B 81/005 206/315.1 |
| 2009/0250468 | A1* | 10/2009 | Whelan | B60K 15/035 220/371 |
| 2009/0255933 | A1* | 10/2009 | Zeyfang | B65D 55/16 220/375 |
| 2014/0360970 | A1* | 12/2014 | Chen | B65D 41/0471 215/217 |
| 2015/0115510 | A1 | 4/2015 | Woods et al. | |
| 2017/0027158 | A1* | 2/2017 | Slangan | A01M 31/008 |

* cited by examiner

VENTILATED SHIPPING TUBE PLUG

BACKGROUND OF THE INVENTION

Field of the Invention

The present invention relates generally to shipping and storage structures. More particularly the present invention relates to a vented end plug for a shipping or display tube.

Description of Related Art

Ventilated shipping containers are important in the shipping field for transportation of living creatures (among other things). However, such shipping containers can be quite expensive, and also are subject to structural failure, chew-out, and other weaknesses.

For example, one industry option for ventilated shipping is a small box having two die cuts in parallel sides. A wire mesh is connected to these cut outs by, for example, stitching, gluing, or stapling to the box. This solution results in a number of weaknesses. For example, production is labor and time intensive, equipment costs can be high, and the weaknesses in the corners of a box, as well as around the mesh provide opportunities for a breaking of the box or being chewed through by the creature being shipped.

Therefore, what is needed is a simple, effective and easy to use solution to provide ventilated shipping containers.

SUMMARY OF THE INVENTION

The subject matter of this application may involve, in some cases, interrelated products, alternative solutions to a particular problem, and/or a plurality of different uses of a single system or article.

In one aspect, a ventilated plug for closing a tube is provided. The ventilated plug has a planar body with a cross sectional area approximately matching an inner or outer cross sectional area of the tube (depending on embodiment). The body has a top face and a bottom face, with at least one opening between the two faces to allow air flow through the body. A rim extends continuously about a perimeter of the body and extends away from the top face approximately (+/−15 degrees) perpendicularly. The plug is configured to fit within the tube to provide a ventilated closure in one embodiment. In another embodiment, the plug provides ventilated closure by frictionally connecting over an outside of the tube at the end of the tube to cover an open end of the tube.

In another aspect, a ventilated and closed shipping tube assembly is provided. The assembly is formed of a shipping tube with a ventilated plug positioned to cover at least one open end of the tube. The ventilated plug is constructed such that at least one small opening allows the passage of air while preventing an escape of contents within the tube. The ventilated plug has a planar body with a cross sectional area approximately matching an inner or outer cross sectional area of the tube. The body has a top face and a bottom face, with at least one opening between the two faces to allow air flow through the body. A rim extends continuously about a perimeter of the body and extends away from the top face approximately (+/−15 degrees) perpendicularly. A bead may protrude from an outer face of the rim to provide increased hold between the rim and the tube.

DETAILED DESCRIPTION

Figure 1:
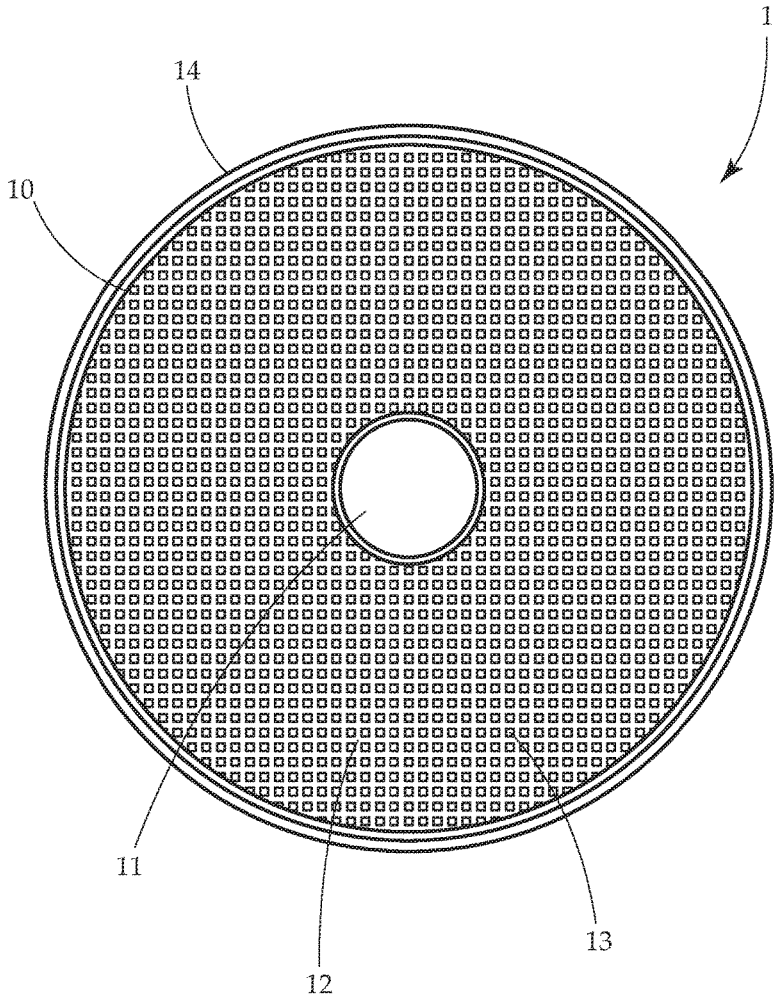
FIG. 1 provides an elevation view of an embodiment of the present invention.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention concerns a ventilated end plug for use in industry standard shipping tubes. The end plug may be used on one or both ends of the tubes, and provides a ventilation through one or a plurality of openings formed in the plug. This ventilated plug seals the tube by, for example, a frictional connection to an open end of the tube.

The opening or openings may be formed in any manner by a surface of the plug. For example, an opening or openings may be formed in the plug during manufacture. In another embodiment, a mesh or screen may be attached (either at manufacture or after) to larger openings in the plug. These openings are configured and sized to allow a passage of air through them. The size of the opening, or the size of the openings of the mesh screen, may vary in size and are not limited by size or other orientation. In most embodiments, the openings or mesh screen aperture size may be large enough to allow passage of air but small enough to prevent the escape of an organism intended to be contained in the tube or other contents of the tube. In a particular embodiment, an opening may be a 0.05" square. In a further embodiment having a plurality of openings, each opening may be a 0.05" square spaced in a grid having 0.06 spacings between each opening.

In a particular embodiment, the plug may be formed by a planar body having a shape selected to match a shape of the shipping tube to which it will connect. For example, the planar body may be a circular disk shape. About the perimeter of the body, a rim may extend away from a first face of the body. At the end of this rim opposite to the body, a flange may extend perpendicularly to the rim and radially outwardly, approximately parallel to the face. In a further embodiment, a bead may extend from either or both the inside or outside of the rim (facing, or facing away from the body, respectively) to facilitate the plug being held in place by the increased/diameter caused by the bead. Selection of the side of the rim that the bead may extend from may depend on if the rim is configured to fit within the tube (would have the bead on the outside) or over an outer diameter of the tube (having the bead on the inside).

While in most embodiments the plug will be pressure-fit to either an outer diameter of the tube or an inner diameter of the tube, it should be understood that any manner of connecting the plug to the tube may be used. For example, an adhesive may be used on a portion of the plug; a snap fitting may be used, a U-shaped flange may be used to wrap around both the inside and outside of the tube end; and the like. Further, in some embodiments, a quantity of tape or adhesive may be used to additionally secure a pressure fitted or frictionally fitted plug to the tube.

The plug may be formed of any material capable of being attached to the tube. Examples of which the plug may be made include, but are not limited to: plastics, particularly semi-rigid plastics, metals, composite materials, rigid or reinforced paper products, and the like.

The shipping tube may be formed of any material capable of being shipped and supporting its own weight. The shipping tube need not be solely for shipping, and the term "shipping tube" is used herein to refer to any elongate structure defining an interior region, and could be any tube used, for example, for display, storage, shipping, and the like. Typically the shipping tube may be made of a cardboard, plastics, or metal material. The tube may be in any elongate shape, such as, for example a tube having a circular, rectangular, triangular, or oval cross section.

The ventilated plug may be used in any shipping or other tube for the purpose of allowing ventilation to the tube. This may be particularly advantageous for the shipping and storage of small creatures such as worms, insects, and small vertebrates.

Figure 2:
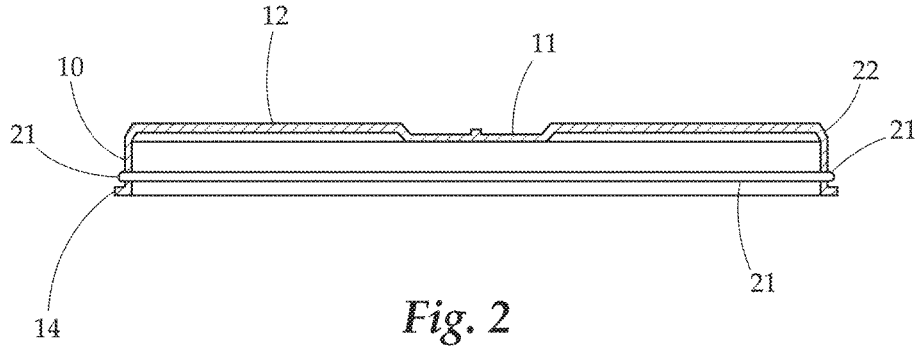
FIG. 2 provides a side view of another embodiment of the present invention.

Turning now to FIG. 1, an elevation view of the plug of the present invention is provided. The plug 1 is formed of a body 12 which is a general planar shaped disk, shown here as a circular disk. The body 12 has a plurality of small holes 13 formed over a portion of its surface. These holes 13 may be formed during manufacture, or may be drilled or otherwise formed after the plug 1 has been manufactured. A central solid area 11 is positioned at the center of the body 12. This may be indented or protrude somewhat from the body (as seen in FIG. 2). A rim 10 extends from a face of the body 12 about its perimeter away from the face. In this embodiment the rim 10 extends approximately perpendicularly (+/−15 degrees) away from the body 12. Flange 14 extends radially away from rim 10. In this embodiment, the flange 14 extends approximately perpendicularly (+/−15 degrees) away from the rim and approximately parallel to the body 12.

FIG. 2 shows a side view of another embodiment of the plug. In this view, the central area 11 is shown slightly indented from a lower face of the body and extending from the upper face. In this view, rim 10 extends from the body 12 and has an angled region 22 that transitions rim 10 to body 12. This angled region 22 may act to guide the plug in place when being placed into the opening of a tube. Bead 21 can be seen extending from an outer face of the rim 10. Bead 21 may act to help secure the plug 1 in place when being placed into the tube because the bead 21 will have an outer diameter slightly greater than an inner diameter of the tube. It should be noted that in embodiments having the plug fitting over an outer diameter of the tube, the bead 21 may be on the inside face of the rim 10. Flange 14 extends away from rim 10 in this embodiment, though it is noted that in some embodiments, flange may extend either or both away from the rim and inwardly from the rim towards a center of the body 12 without straying from the scope of the invention.

Figure 3:
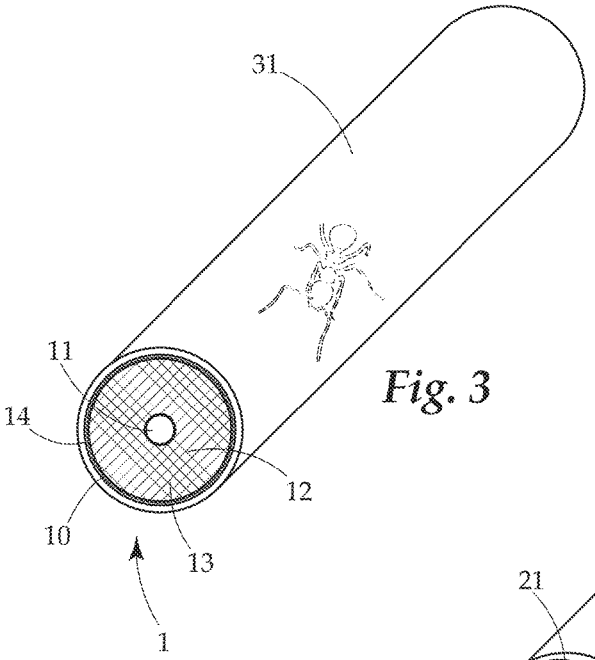
FIG. 3 provides a perspective view of an embodiment of the present invention shown closing an opening of a tube.

FIG. 3 provides a view of an embodiment of the plug of the present invention attached to a shipping tube. The shipping tube 31 is cylindrical in shape and defines an interior (not shown). The plug 1 is shown in this embodiment fitting to an inner diameter of tube 31. Flange 14 extends outwardly from rim 10 and prevents the plug 1 from being inserted too far into the tube 31. The body 12 of plug 1 has a plurality of openings 13 providing air flow into the tube 31. A central area 11 of this embodiment is a solid portion. In this embodiment, a living organism may be placed within the tube 31 and may be able to breathe comfortably because of the air flow through the plug 1. As noted earlier, while the plug 1 of this figure is shown fitting inside the tube 31 and frictionally connecting between an outer edge of the rim 10 and the inner face of the tube 31, it should be understood that the plug may connect to the tube over an outside of the tube, between an inner edge of the rim and an outer face of the tube.

Figure 4:
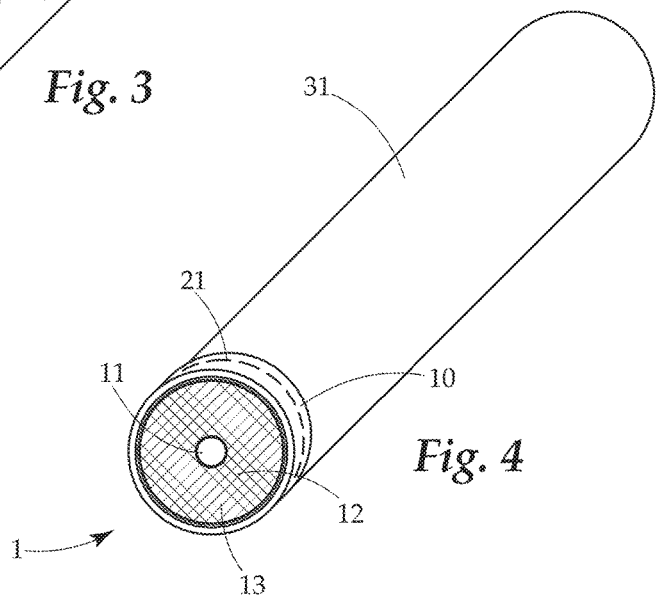
FIG. 4 provides a perspective view of another embodiment of the present invention shown closing an opening of a tube.

FIG. 4 provides a view of an embodiment of the plug of the present invention attached to a shipping tube. The shipping tube 31 is cylindrical in shape and defines an interior (not shown). The plug 1 is shown in this embodiment fitting to an outer diameter of tube 31. The body 12 of plug 1 has a plurality of openings 13 providing air flow into the tube 31. Bead 21 can be seen in broken lines extending from an inner face of the rim 10 engaged with the shipping tube. Bead 21 may act to help secure the plug 1 in place when being placed over the shipping tube because the bead 21 will have an inner diameter slightly less than an outer diameter of the tube. A central area 11 of this embodiment is a solid portion. In this embodiment, a living organism may be placed within the tube 31 and may be able to breathe comfortably because of the air flow through the plug 1.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A ventilated shipping tube and living organism assembly comprising:

a cylindrical shipping tube, the shipping tube being an elongate unit having a body that defines an interior section, the tube and interior section having an approximately continuous cross sectional shape;

a plug positioned at least partially within the interior section at an end of the shipping tube, the plug comprising:

a planar body having a top face and a bottom face, the body having a plurality of openings between the top face and the bottom face, each of the plurality of openings sized to allow atmospheric pressure air flow through the body and to prevent a passage of contents within the interior section of the tube such that a living organism within the interior section of the tube may breathe and be retained within the tube;

a rim extending continuously about a circular perimeter of the body from the top face, the rim extending approximately perpendicularly to the top face of the body; and wherein the rim further comprises an integrally formed bead protruding on an outer face of the rim and the bead extends continuously around an entire length of the outer face of the rim;

the plug further comprising a flange extending from an end of an entirety of the rim opposite to the top face, the flange abutting a top edge of the shipping tube;

the plug positioned in the interior section of the shipping tube such that it is frictionally connected to an smooth inner face of the shipping tube by the outer face of the rim and the bead forming a pressure fit between the plug and the shipping tube thereby providing an overlap between the plug and the edge of the shipping tube, the overlap limiting a breaking or chew through by the living organism;

the assembly further comprising:

a second removable closure attached to the tube in an end opposite to the end having the plug the second plug comprising:

a second planar body having a second top face and a second bottom face, the second body having a second plurality of openings between the second top face and the second bottom face sized to allow a second, different air flow passage into the tube through the second body;

a second rim extending continuously about a second perimeter of the second body away from the second top face, the second rim extending approximately perpendicularly to the second top face of the second body; and wherein the second rim further comprises a second bead protruding on an outer face of the second rim;

the second plug positioned in the interior section of the shipping tube on an end of the tube opposite to the plug such that it is frictionally connected to an inner face of the shipping tube by the second outer face of the second rim and the second bead;

the assembly further comprising: a living organism contained within the interior section by the plug and the second plug, the living organism being at least one of a worm, and an insect.

2. The ventilated shipping tube assembly of claim 1 wherein the body further comprises a continuous center area protruding upward from the top face.

3. The ventilated shipping tube assembly of claim 1 further comprising an angled transition between the body and the rim having an area angled inward from the rim towards the body.

4. The ventilated shipping tube assembly of claim 1 wherein the shipping tube is formed of a cardboard or a plastic.

5. The ventilated shipping tube assembly of claim 1 wherein each of the plurality of openings is a 0.05" square spaced in a grid having 0.06 spacings between each of the plurality of openings.

6. A ventilated shipping tube and living organism assembly comprising:

a cylindrical shipping tube, the shipping tube being an elongate unit having a body that defines an interior section, the tube and interior section having an approximately continuous cross sectional shape;

a plug positioned to cover an end of the shipping tube, the plug comprising:

a planar body having a top face and a bottom face, the body having a plurality of openings between the top face and the bottom face, each of the plurality of openings sized to allow atmospheric pressure air flow through the body and to prevent a passage of contents within the interior section of the tube such that a living organism within the interior section of the tube may breathe and be retained within the tube;

a rim extending continuously about a circular perimeter of the body away from the top face, the rim extending approximately perpendicularly to the top face of the body; and wherein the rim further comprises an integrally formed bead protruding on an inner face of the rim and the bead extends continuously around an entire length of inner face of the rim;

the plug positioned to cover the end of the shipping tube such that it is frictionally connected to an outer face of the shipping tube by the inner face of the rim and the bead, forming a pressure fit between the plug and the shipping tube thereby providing an overlap between the plug and the edge of the shipping tube, the overlap limiting a breaking or chew through by the living organism;

the assembly further comprising:

a second removable closure attached to the tube in an end opposite to the end having the plug the second plug comprising:

a second planar body having a second top face and a second bottom face, the second body having a second plurality of openings between the second top face and the second bottom face sized to allow a second, different air flow passage into the tube through the second body;

a second rim extending continuously about a second perimeter of the second body away from the second top face, the second rim extending approximately perpendicularly to the second top face of the second body; and wherein the second rim further comprises a second bead protruding on an outer face of the second rim;

the second plug positioned in the interior section of the shipping tube on an end of the tube opposite to the plug such that it is frictionally connected to an inner face of the shipping tube by the second outer face of the second rim and the second bead;

the assembly further comprising: a living organism contained within the interior section by the plug and the second plug, the living organism being at least one of a worm, and an insect.

7. The ventilated shipping tube assembly of claim 6 wherein the body further comprises a continuous center area protruding upward from the top face.

8. The ventilated shipping tube assembly of claim 6 wherein each of the plurality of openings is a 0.05" square spaced in a grid having 0.06 spacings between each of the plurality of openings.

* * * * *